United States Patent [19]

Matchick

[11] 3,979,116

[45] Sept. 7, 1976

[54] STRIDE-BOX

[76] Inventor: John T. Matchick, 126 N. Master's Court, Maumee, Ohio 43537

[22] Filed: Mar. 7, 1975

[21] Appl. No.: 556,333

[52] U.S. Cl. ..... 273/26 R; 35/29 R

[51] Int. Cl.[2] ..... A63B 69/40

[58] Field of Search ..... 35/29 R, 29 A, 29 C, 35/29 E; 273/1 A, 26 R, 29 A, 54 D, 187 R, 187 A, 188 A; 33/174 F

[56] References Cited

UNITED STATES PATENTS

| | | | |
|---|---|---|---|
| 2,777,697 | 1/1957 | Crossot | 273/187 R |
| 2,891,793 | 6/1959 | Mudry | 273/1 A |
| 3,342,487 | 9/1967 | David | 273/26 R |
| 3,768,809 | 10/1973 | Ciarfello | 273/1 A |
| 3,815,906 | 6/1974 | Hermo | 273/26 R |

OTHER PUBLICATIONS

Sears Fall–Winter 1963 Catalog, "Tarpaulins," on p. 811 only.

*Primary Examiner*—Harland S. Skogquist
*Attorney, Agent, or Firm*—Richard D. Emch

[57] ABSTRACT

A batter's training device is disclosed. The training device comprises a sheet material which defines a first pivot foot opening and a second stride foot opening. Means are provided in the stride foot opening for adjusting the distance of the stride foot opening from the pivot foot opening and for adjusting the length of the stride foot opening.

10 Claims, 2 Drawing Figures

STRIDE-BOX

BACKGROUND OF THE INVENTION

For a baseball player to develop batting skills, it is necessary that he learn a proper stance with respect to home plate and a proper stride toward the pitcher's mound as he swings his bat at a pitched ball. The batter's stance is the ready position which the batter assumes as he awaits the pitch. It is important that the batter stands facing home plate with his feet spaced apart enough to provide him maximum balance and still to permit him to stride into the ball as he swings his bat.

The batter's stride is the step which he takes with his leading foot (the foot nearest the pitcher's mound as the batter stands facing home plate) away from his stationary pivot foot toward the pitcher's mound as he swings at the ball. It is important that the batter take his stride step in order to place his full weight into his swing to obtain maximum impact on a pitched ball.

It is essential, however, that the stride be relatively short. Experienced baseball players have found that the length of the stride (i.e., the distance which the batter moves his leading foot from his stance position toward the pitcher's mound as he swings his bat) should be 6 inches or less, depending upon the size of the player. If the batter "over strides" as he swings, the forward movement of his leading leg lowers his upper body. Therefore at the moment the pitched ball is crossing the impact zone, the overstriding batter carries his head down, placing his eyes on a different plane than they were when he was in his stance position. The result is that the batter's perception of the path of the pitched ball radically changes at the time the ball is being hit, thereby making it difficult if not impossible for him to correctly judge the pitch.

The present invention is a training device for teaching the batter a proper stance and stride. Prior art stance and stride teaching devices, such as that disclosed in U.S. Pat. No. 3,342,478 have been difficult to use because they have not been adjustable to the requirements of individual batters. Furthermore, the prior art training devices have often been rigid and bulky and therefore more limited in use due to their poor portability.

The stance and stride training device of the present invention is adjustable to accommodate the batter's size and is, at the same time, foldable into a light-weight compact carrying package. The device can be used in-doors or out and requires very little space when in use.

SUMMARY OF THE INVENTION

The invention comprises a batter's training device. The training device comprises a sheet material defining a first pivot foot opening and a second stride opening. Flap means are provided in the stride opening for adjustably locating the distance of the stride opening from the pivot foot opening and for adjusting the size of the stride opening. In one embodiment, means are also provided for locating a home plate relative to the stride opening and for indicating the proper point of contact between the batter's bat and a pitched ball as the ball approaches the home plate.

DESCRIPTION OF THE PREFERRED EMBODIMENT

Figure 1:
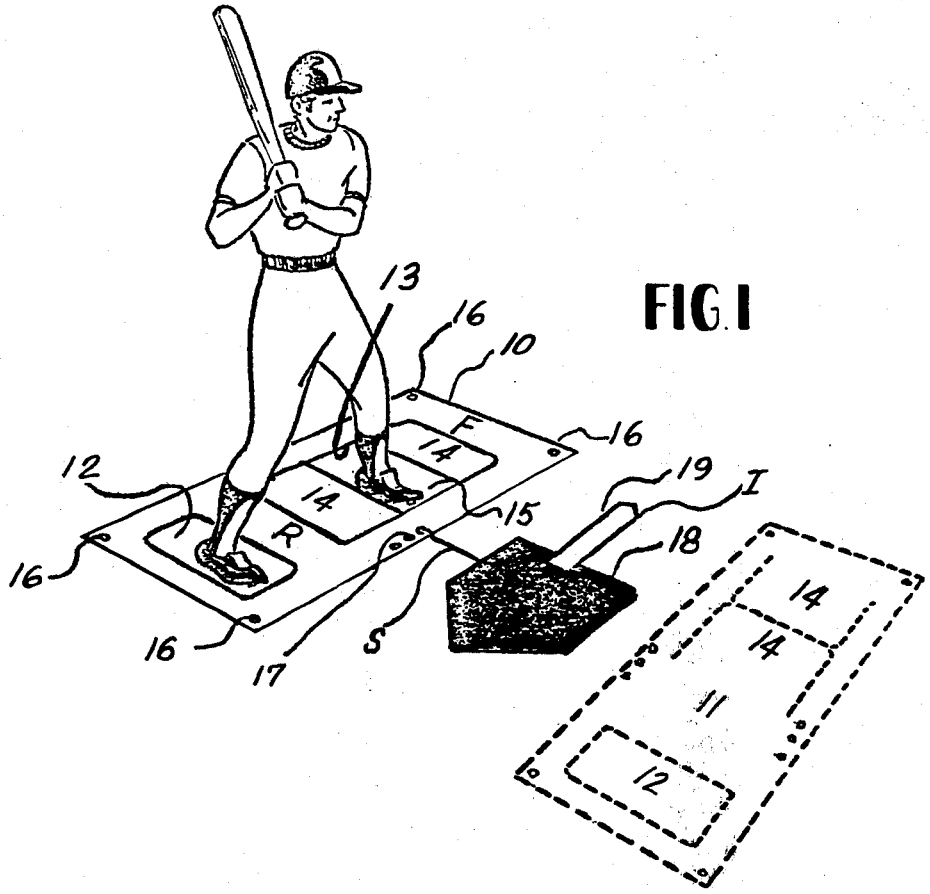
FIG. 1 is a perspective view of the training device of the present invention in location adjacent a home plate for use by a right-handed batter.

Referring to the drawings, a batter's training device 10 according to the present invention is shown. The training device 10 comprises a web or sheet material 11, such as nylon or canvas, which is preferably foldable into a compact carrying package. The sheet material is of various thicknesses depending on the type of web or sheet material used.

The sheet material 11 defines a rear (with respect to the pitcher's mound) pivot foot opening 12 and a forward stride foot opening 13. Movable flaps 14 are respectively connected adjacent front and rear portions (F & R) of the stride foot opening 13. The flaps 14 are foldable or otherwise movable to define a stride area 15 which is limited by the sides of the stride foot opening 13 and the folded edges of the front and rear flaps 14.

Grommets 16 at the corners of the sheet material 11 provide a means for staking down the training device 10 if so desired. Spaced locating eyelets 17 are provided in the sheet material 11 adjacent the stride foot opening 13 for locating a home plate 18 with respect to a batter's stance position as will be explained below. A spacer indicator finger s, comprising a flexible wire or string, is connected to one side of the plate 18 and extends toward one of the locating eyelets 17 for locating the plate 18 relative to the sheet 11.

The home plate 18 preferably comprises any foldable plastic or rubber-like substance which can be readily rolled for carrying. A guide marker 19 is connected to a center leading edge of the home plate and extends in the direction of a pitcher's mount (not shown). The guide marker 19 extends a distance of about 12 inches to a point in a plane perpendicular to an imaginary line where the batter should contact the ball as he executes his swing.

Figure 2:
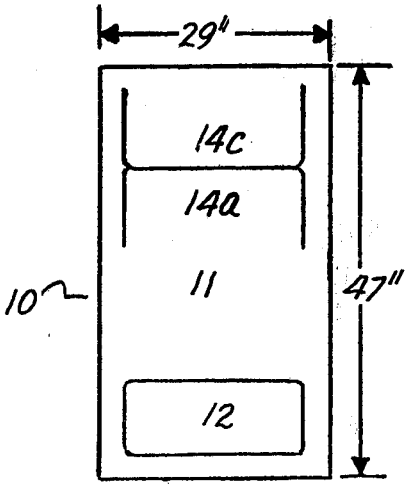
FIG. 2 is a plan view of the training device shown in FIG. 1.

As shown in FIG. 2, the preferred dimensions of the sheet material 11 are 47 inches by 29 inches. While the size of the sheet material 11 could be varied, the dimensions shown are found to be ideal for facilitating maximum adjustability of the training device 10 as well as for each folding of the sheet material 11 into a compact package.

In alternative embodiments of the present invention, the stride foot area, for example, may comprise a painted area on the material 11 rather than an opening. However, in any embodiment adjustments must be possible to both the foot stance position and the foot stride position to accommodate batters of various physical sizes.

In use, the sheet material 11 of the training device 10 is placed either on the "right hand" or "left hand" side of the plate 18 as is shown in the respective solid and dashed-line illustrations of FIG. 1. The batter selects a locating eyelet 17 for receiving the indicator finger s which extends between the parallel edges of the sheet material 11 and the home plate 18. By aligning the indicator finger s with one of the spaced locating eyelets 17, the plate 18 is placed in a predetermined relationship with the edge of the web material 11. The batter selects the locating eyelet 17 which he prefers, depending on whether he is most comfortable having his stride foot toward the rear, in the middle, or toward the front of the plate 18.

The batter than places his pivot foot in the pivot foot opening 12 and his stride foot in the stride foot opening 13 at a point in the opening 13 which affords him his most ideal stance. The batter's stance — the distance between his pivot and stride feet — is the point at which he can maintain maximum balance and stability as he faces the plate 18 with his body while turning his head toward the pitcher's mound. Because this will vary among individuals, it is necessary that the training device 10 does not restrict this stance to any single distance.

Once the batter chooses his most comfortable stance, the rear flap 14*a* is extended forward until it meets the inside edge of the batter's stride foot. The front flap 14*b* is then extended rearwardly in the stride foot opening 13 until the length of the stride area 15 (the distance between the folded edges of the flaps 14) in 6 inches or less.

Once the device is thus adjusted by the batter, he practices swinging his bat and striding toward the pitcher's mound (the direction parallel to the direction in which the guide marker 19 points) keeping his foot within the stride area 15.

If the batter over-strides on his swing, he will step outside of the stride area onto the flap 14 or the sheet material 11. If he under-strides during his swing, the outside edge of his foot will not contact the rear edge of the front flap 14.

By repeated use of the training device 10, the batter will soon learn to take a short stride which will enable him to maintain his balance and head position and yet obtain maximum impact on a pitched ball. At the same time, the batter can train himself to anticipate meeting the pitched ball at an imaginary line extending vertically from the end of the guide marker 19. The batter can therefore learn to anticipate the optimum impact point between his bat and the pitched ball without over-striding or stepping outside of the stride area 15. The training device 10 therefore will aid the batter in learning to stay inside of the batter's box without stepping toward the plate to swing at pitches crossing the outside of the stride zone.

It is understood that the foregoing description of the preferred embodiment of the present invention, including stated dimensions in materials, are only exemplary and should in no way limit the scope and bredth of the following claims.

What I claim is:

1. A batter's training device comprising a planar sheet material defining a first area for receiving a batter's rear pivot foot and a second area for receiving a batter's leading stride foot, said second area being spaced apart from said first area and said second area having a first length, means adjacent at least one of said first or said second foot areas for adjustably setting a distance between said first and second areas and means adjacent said second area for altering said first length to a second length, whereby the adjusting of such distance between such first and second areas defines a desired stance and the altering of such lengths defines a desired stride.

2. A batter's training device comprising a planar sheet material defining a first area for receiving a batter's pivot foot and a second area for receiving a batter's stride foot, first closure means adjacent at least one of said first or said second areas for adjustably setting a first distance between said first and said second areas and second closure means adjacent said second area for adjustably changing the length dimension of said second area.

3. A batter's training device according to claim 2 wherein said first closure means comprises a first extendable flap connected adjacent at least one of said first and second foot areas.

4. A batter's training device according to claim 2 wherein said web or sheet material comprises canvas.

5. A batter's training device according to claim 2 wherein said web or sheet material comprises nylon.

6. A batter's training device according to claim 2 wherein said second closure means comprises an extendable flap connected adjacent said second foot area.

7. A batter's training device according to claim 2 including a home plate adjacent said material, guide means connected to said home plate for indicating a proper point of contact between a batter's bat and a pitched ball, and locating means for locating said plate in a proper relationship with said foot areas on said sheet material.

8. A batter's training device according to claim 7 wherein said guide means comprises a marker connected to a center leading edge of said plate and extending from said plate toward a pitcher's mound a distance of about 12 inches.

9. A batter's training device according to claim 7 wherein said locating means comprises a finger connected to a side edge of said plate and spaced locating point means defined by said web material for receiving an end of said finger.

10. A batter's training device comprising a planar sheet material defining two openings therein for receiving the feet of a batter, means for adjusting space between said openings for assisting the batter in selecting a consistant stance and second means for adjusting the size of one of said openings, whereby the batter is assisted in achieving a consistant stride as he swings at a pitched ball.

* * * * *